United States Patent [19]

Lile et al.

[11] 4,042,232

[45] Aug. 16, 1977

[54] EXTREMITY HOLDER FOR MOUNTING ON AN OPERATING TABLE

[75] Inventors: Barbara A. Lile; Robert M. Lane, both of Wichita; Louise A. Everhart, Derby, all of Kans.

[73] Assignee: L. E. L., Inc., Wichita, Kans.

[21] Appl. No.: 731,320

[22] Filed: Oct. 12, 1976

[51] Int. Cl.[2] ..... A61G 13/00

[52] U.S. Cl. ..... 269/328

[58] Field of Search ..... 269/328, 322; 248/279, 248/285, 124

[56] References Cited

U.S. PATENT DOCUMENTS

| | | | |
|---|---|---|---|
| 2,459,033 | 1/1949 | Kraus | 269/328 |
| 3,151,595 | 10/1964 | Stainbrook | 248/124 |
| 3,572,835 | 3/1971 | Kees | 269/328 |
| 3,745,996 | 7/1973 | Rush | 269/328 |

FOREIGN PATENT DOCUMENTS

| | | | |
|---|---|---|---|
| 1,224,721 | 6/1960 | France | 248/124 |

*Primary Examiner*—Al Lawrence Smith
*Assistant Examiner*—Robert C. Watson
*Attorney, Agent, or Firm*—Edwin H. Crabtree; John H. Widdowson

[57] ABSTRACT

An extremity holder for mounting on an operating table. The holder provides means for supporting a sling attached to a patient during the preparation for surgery and during the operation. The holder can be adjusted both vertically, horizontally and pivoted to a position above and adjacent the operating table.

2 Claims, 5 Drawing Figures

EXTREMITY HOLDER FOR MOUNTING ON AN OPERATING TABLE

BACKGROUND OF THE INVENTION

This invention relates generally to accessories for attaching to an operating table, and more particularly but not by way of limitation, to an extremity holder for supporting a sling attached to a patient.

Heretofore, there have been a number of different types of limb supports and obstetrical appliances used for supporting the arms and legs of a patient.

None of the prior art supports have provided adjustable extremity holder for mounting to an operating table and supporting a sling attached to the patient. Also, these prior art devices were not adaptable for accomodating patients of different heighths and weights. Again, the prior art devices were adapted for primarily one type of operation and were not adaptable for a variety of different types of operations that are performed on the operating table.

The following described invention provides a novel extremity holder for mounting to the end or the side of an operating table.

SUMMARY OF THE INVENTION

The subject invention is rugged in structure and provides support for the patients limbs or body during the preparation for surgery when it is necessary to have an extremity draped and available for operation.

The extremity holder eliminates the need of hospital personnel having to support or elevate the extremity of the patient during the preparation and operation of the patient and prevents the moving and jostling of the extremities which may already be injured.

The invention removes the need of make-shift supports, and is readily adaptable for attaching to various types of operating tables.

The extremity holder may be used for a variety of different types of operations, such as arthrotomies of the knees and shoulders, hip prosthesis rib resections, and other related procedures where it is necessary to elevate the shoulder, arm, or leg in order to prepare the area for surgery. Also the holder may be used in vein strippings and multiple surgeries on the extremity, when turning of the patient under anesthesia is inadvisable.

The invention is adjustable both vertically and horizontally. Also, the horizontal arm of the holder is adapted so that it can pivot 360° on top of a vertical standard so that the holder can be adjusted above and adjacent to the operating table.

The extremity holder includes a base for attaching to the end and the side of the operating table. A vertical standard having an adjustable inner tube and outer tube is attached to the top of the base and extends upwardly therefrom. Attached to the top of the standard is an adjustable horizontal arm. The arm includes an inner tube and an outer tube for adjusting the length of the arm. Attached to the end of the arm is a hook. The hook is used for supporting a sling which is attached to the patient.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
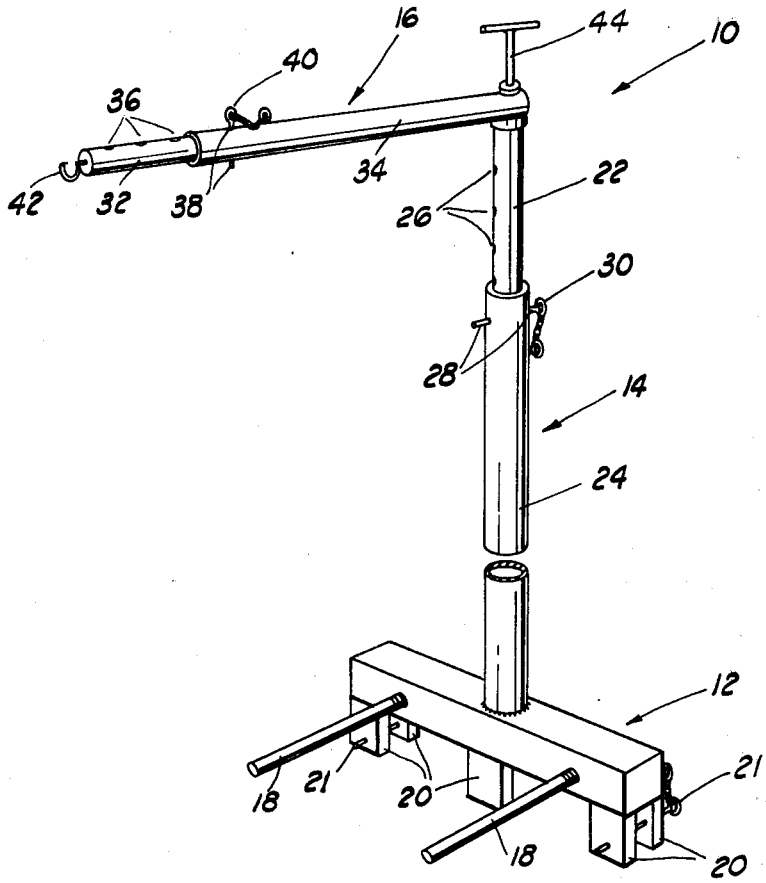
FIG. 1 is a perspective view of the extremity holder.

In FIG. 1, the extremity holder for mounting on an operating table is designated by general reference numeral 10. The holder 10 includes a base 12 having a vertical standard 14 attached to the top thereof. A horizontal arm 16 is pivotly attached to the top of the vertical standard 14.

The base 12 includes a pair of horizontally mounted rods 18 having one end threaded into the sides of the base 12. Attached to the bottom of the base 12 and extending downwardly therefrom, are a plurality of lugs 20 having apertures in the ends thereof. The lugs 20 are used for attaching the holder 10 to an accessory rail mounted on the sides of the operating table. The lugs 20 secure the holder 10 to the rail by inserting pins 21 through the apertures in the ends of the lugs 20.

The vertical standard 14 includes an inner tube 22 slidably mounted inside an outer tube 24. The inner tube 22 includes a plurality of apertures 26. The outer tube includes a pair of apertures 28. By indexing a selected pair of apertures 26 in the inner tube 22 with the apertures 28 of the outer tube 24, the vertical heighth of the standard 14 is adjusted. The tubes 22 and 24 are secured together by inserting a pin 30 through the apertures.

The horizontal arm 16 is also characterized by having an inner tube 32 slidably mounted in an outer tube 34. The inner tube 32 includes a plurality of apertures 36. The outer tube 34 includes a pair of apertures 38. By indexing the apertures 36 of the inner tube 32 with the apertures 38 of the outer tube 34 and inserting a pin 40 therein, the horizontal length of the arm 16 is adjusted.

A hook 42 is attached to the end of the inner tube 36 of the arm 16. The hook 42 is used for supporting a sling attached to the extremity of the patient on the operating table.

The horizontal arm 16 is pivotly attached to the top of the standard 14 by a "T" shaped tightner 44. By loosening the tightener 44, the arm 16 can be pivoted to a desired position above or adjacent the operating table.

Figure 2:
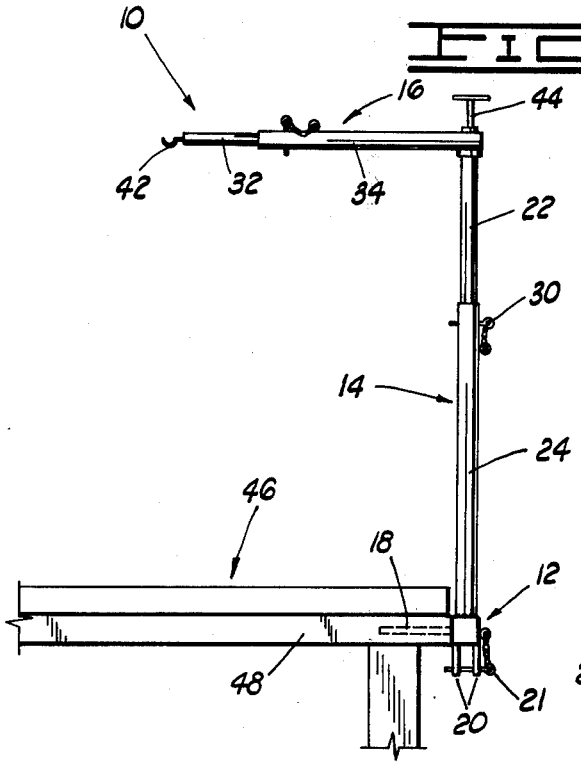
FIG. 2 is a side view of the holder attached to the end of an operating table.

In FIG. 2, a partial view of an operating table 46 is seen. In this view, the holder 12 is attached to the end of the table 46 through the use of the rods 18 shown in dotted lines. The rods 18 are inserted into apertures 47 in the end of a frame 48 of the table 46. The apertures 47 are shown in FIG. 3.

Figure 3:
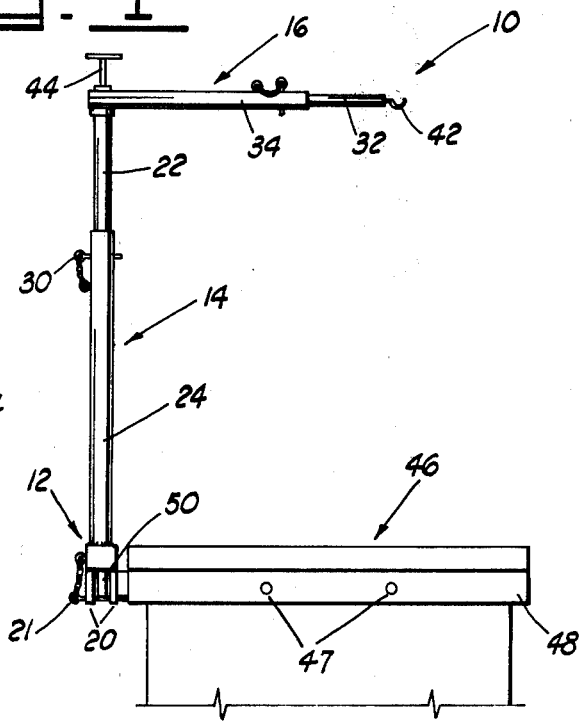
FIG. 3 is a side view of the holder attached to the side of an operating table.

In FIG. 3, an alternate method of attaching the holder 10 to the operating table 46 is illustrated. In this view, the holder 10 is attached to an accessory rail 50, which runs along the length of the side of the operating table 46.

Figure 4:
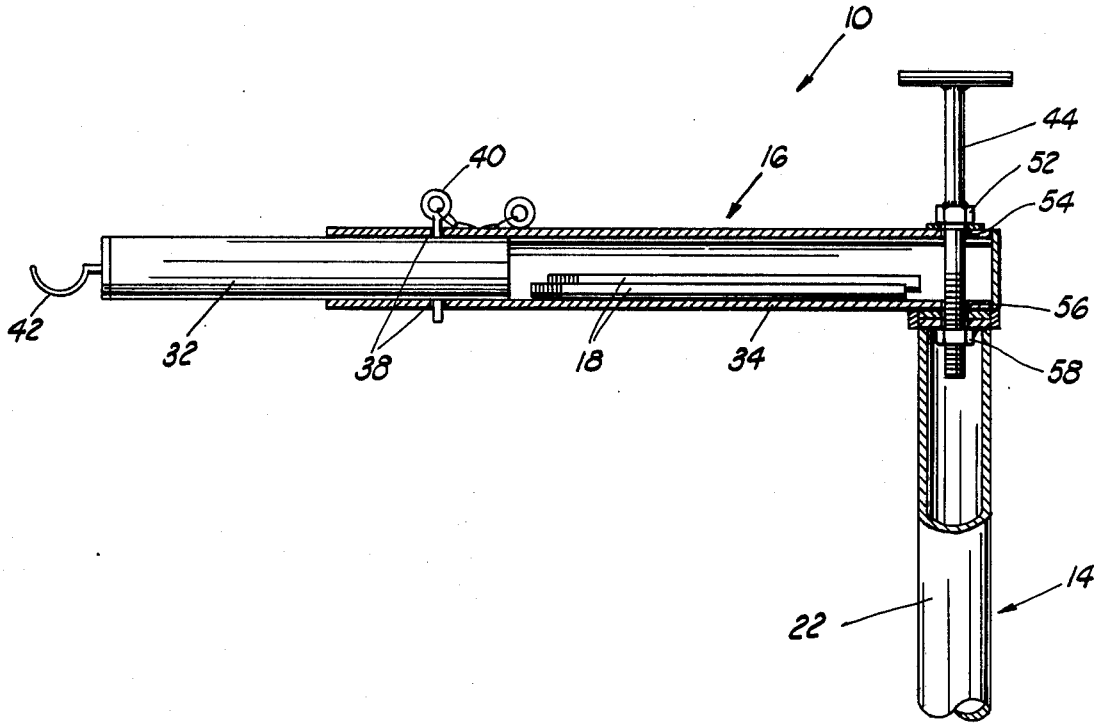
FIG. 4 is a side view of the holder with a cut-away portion of the horizontal arm and vertical standard.

FIG. 4 illustrates a partial cut-away view of the vertical standard 14, and the arm 16. When the holder 10 is attached to the accessory rail 50 of the operating table 46, the rods 18 are threadably removed from the sides of the base 12. In this view, the rods 18 are seen stored inside the outer tube 34. The rods 18 are removed and attached to the base 12 when it is desired to secure the holder 10 to the end of the operating table 46 as shown in FIG. 2.

In this view, the tightener 44 is attached to the top of a threaded bolt 52. The bolt 52 is inserted through an aperture 54 in the end of the arm 16 and through an aperture 56 in the top of the standard 14. The bolt 52 is threaded into a nut 58. By loosening the bolt 52 on the nut 60, the tightner 44 loosens the arm 16 so that it can be pivoted 360° on top of the standard 14. By pivoting the arm 16 on top of the standard 14, the hook 42 can be disposed over a desired position in supporting a sling attached to the patient. When the arm 16 is in the correct position, the tightner 44 is turned, thereby tightening the bolt 52 in the nut 58, thereby holding the arm 16 in place on top of the standard 14.

Figure 5:
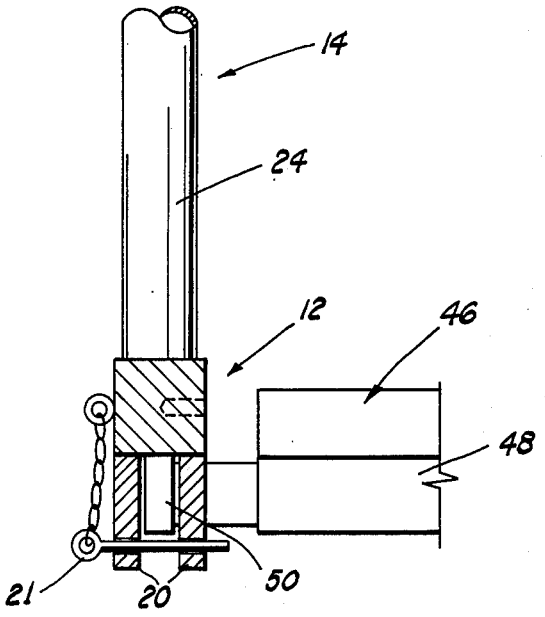
FIG. 5 is a cut-away view of the bottom portion of the base attached to the side of an operating table.

In FIG. 5, an enlarged sectional view of the base 12 and lugs 20 are illustrated. In this view, a pair of lugs 20 are seen disposed on each side of the accessory rail 50. In this position the pin 21 is inserted through the apertures at the bottom of the lugs 20 thereby securing the lugs 20 to the accessory rail 50 and mounting the holder 14 in place along the side of the operating table 46.

Changes may be made in the construction and arrangement of the embodiment as disclosed herein without departing from the spirit or scope of the invention as defined in the following claims.

We claim:

1. An extremity holder for mounting on an operating table, the holder comprising:

a base;

a pair of rods having threaded ends, said rods threadably mounted to one side of said base, said rods received in apertures in the end of the operating table for securing the holder to the end of the operating table;

a plurality of downwardly extending lugs attached to the bottom of said base, said lugs received adjacent the side of an accessory rail mounted along the side of the operating table, said lugs pinned to the rail of the operating table for securing the holder to the side of the operating table;

a vertical standard having an inner tube slidably mounted inside an outer tube, said tubes having a plurality of apertures therethrough for receiving a pin therein for adjusting the vertical heighth of said standard;

a horizontal arm having an outer tube and an inner tube, said inner tube slidably mounted inside said outer tube, said tubes having a plurality of apertures therethrough for receiving a pin therein for adjusting the horizontal length of said arm; and a hook attached to one end of said arm, said hook used for holding a sling attached to a patient on the operating table.

2. The holder as described in claim 1, further including a "T" shaped tightner attached to said arm and the top of said standard, said tightner securing said arm in place on top of said standard and by loosening said tightner allowing said arm to pivot on top of said standard.

* * * * *